US007617922B2

(12) United States Patent
Bell et al.

(10) Patent No.: US 7,617,922 B2
(45) Date of Patent: Nov. 17, 2009

(54) COIN ACCEPTOR

(75) Inventors: Malcolm Reginald Hallas Bell, Leeds (GB); Kevin Charles Mulvey, Warrington (GB)

(73) Assignee: Money Controls Limited, Royton Oldham (GB)

( * ) Notice: Subject to any disclaimer, the term of this patent is extended or adjusted under 35 U.S.C. 154(b) by 185 days.

(21) Appl. No.: 10/551,511

(22) PCT Filed: Apr. 2, 2004

(86) PCT No.: PCT/GB2004/001457

§ 371 (c)(1),
(2), (4) Date: Oct. 3, 2006

(87) PCT Pub. No.: WO2004/088597

PCT Pub. Date: Oct. 14, 2004

(65) Prior Publication Data

US 2007/0039800 A1 Feb. 22, 2007

(30) Foreign Application Priority Data

Apr. 4, 2003 (GB) ..... 0307880.5

(51) Int. Cl.
*G07F 1/04* (2006.01)

(52) U.S. Cl. ..... 194/344

(58) Field of Classification Search ..... 194/344
See application file for complete search history.

(56) References Cited

U.S. PATENT DOCUMENTS

| | | | | |
|---|---|---|---|---|
| 3,907,086 | A | 9/1975 | Willis | |
| 4,062,435 | A * | 12/1977 | Chalabian | 194/233 |
| 4,821,863 | A | 4/1989 | Okada | |
| 4,989,714 | A * | 2/1991 | Abe | 194/317 |
| 5,480,348 | A * | 1/1996 | Mazur et al. | 453/10 |
| 6,109,417 | A * | 8/2000 | Kovens et al. | 194/345 |
| 6,173,826 | B1 | 1/2001 | Furneaux | |
| 6,206,167 | B1 * | 3/2001 | Taylor et al. | 194/344 |
| 2003/0150687 | A1 * | 8/2003 | King | 194/207 |

FOREIGN PATENT DOCUMENTS

| | | |
|---|---|---|
| CA | 2 293 767 A | 6/2001 |
| EP | 0 704 825 | 4/1996 |
| GB | 2 169 429 | 7/1986 |
| WO | WO 99/23615 A | 5/1999 |
| WO | WO 01/59714 A | 8/2001 |

* cited by examiner

*Primary Examiner*—Patrick Mackey
*Assistant Examiner*—Mark Beauchaine
(74) *Attorney, Agent, or Firm*—Orrick Herrington & Sutcliffe, LLP

(57) ABSTRACT

A coin acceptor includes a coin sensing station with two generally circular coils (S1, S2) and an elongate coil (S3) mounted on one side of a coin guiding surface that is curved so that a coin (26) under test is thrown by centripetal force into sliding engagement with the surface (22) to form an inductive coupling with the coils to test coin acceptability.

14 Claims, 9 Drawing Sheets

COIN ACCEPTOR

FIELD OF THE INVENTION

This invention relates to an improved acceptor for coins, tokens or like items with an attributable monetary value.

BACKGROUND OF THE INVENTION

Conventional coin acceptors include a coin rundown path down which coins travel through a sensing station where sensors detect characteristics of the coin. Examples are described in our GB-A-2 169 429 and WO99/23615. Typically, inductive sensors are provided at the sensing station which perform inductive coin tests and produce coin parameter signals that are a function of the material and metallic content of the coin under test. Other sensors may be used, such as one or more optical sensors. The coin parameter signals are digitised and compared with stored coin data by means of a micro controller to determine the acceptability and often the denomination of the tested coin. If the coin is found to be acceptable, the micro controller operates an accept gate and the coin is directed to an accept path, but otherwise the accept gate remains closed and the coin is directed to a reject path.

The coin rundown path comprises an inclined rundown surface or flight deck, along which the coins roll edgewise through the coin sensing station, the flight deck being disposed between closely spaced, generally upwardly extending side walls which maintain the coin with its perimeter edge on the flight deck. One or both of the side walls may be inclined to the vertical so to encourage the coin under test to tip over whilst moving down the flight path, so that one of its major surfaces tends to slide along one of the side walls. This is intended to reduce wobbling of the coin on the rundown path. Coin wobble can vary the distance between the inductive sensors and successive coins as they pass through the sensing station, and produce an unwanted variation in the inductive coupling with the sensors from coin to coin as they are tested, which degrades the coin parameter signals.

Coins may become jammed in the coin rundown path. Conventionally, this problem has been addressed by moving the side walls apart to clear the jam. One of the sidewalls is formed as a part of the main body of the acceptor and the other side wall is defined by a surface on a door that is hinged on the main body. In the event of a coin jam, a release mechanism is operated to open the hinged door slightly, thereby moving apart the side walls so that the jammed coin can fall off the flight deck and into the reject path. The provision of a door however, undesirably adds to the manufacturing cost of the coin acceptor. Also, if the sensors are mounted on the door, a flexible wiring harness needs to be provided to accommodate the hinge and connect the sensors to the micro controller on the main body. The harness also adds to the manufacturing cost.

SUMMARY OF THE INVENTION

In accordance with invention there is provided a coin acceptor comprising a coin sensing station, a coin rundown path extending through the sensing station, the path including a coin guiding surface on which a major face of the coin lies in sliding engagement during its passage along the path through the sensing station, wherein the path is curved such that the said face of the coin is urged by centripetal force against the coin guiding surface as it moves along the path.

The pressing of the major surface of the coin against the coin guiding surface by centripetal force reduces the likelihood of coin wobble. Also, the coin path can be made much wider than hitherto, which may obviate the need for a coin jam release mechanism such as the hinged door often used hitherto.

The coin acceptor may have a main body with the coin guiding surface, and a cover mounted on the body, such that the coin path extends between said surface and the cover. The cover can fixedly mounted on the body, without the need for a coin jam release mechanism.

A coin inlet may be provided, with a curved inlet surface for guiding a coin inserted in the inlet to a particular region of the coin guiding surface.

The invention also provides a coin acceptor comprising a coin sensing station, a coin rundown path extending through the sensing station, and sensor coils at the coin sensing station, one of said coils comprising an elongate winding extending longitudinally along the coin rundown path.

The elongate coil may be wound on an elongate former which is longer than it is wide and may be longer than the maximum diameter of coins to be accepted thereby. Processing circuitry may be coupled to the elongate coil to derive therefrom a coin parameter signal as a function of coin diameter.

At least one coil of circular cross section may also be provided at the sensing station, which has a diameter smaller than the minimum diameter of coins to be accepted.

The invention further includes a coin acceptor comprising a coin sensing station, a coin rundown path extending through the sensing station, the path including a curved coin guiding surface on which a major face of the coin lies in sliding engagement during its passage along the path through the sensing station, and a side wall opposite to the coin guiding surface, said coin rundown path extending between the coin guiding surface and the sidewall, wherein said side wall is fixedly mounted relative to the curved coin guiding surface.

The invention also provides a coin acceptor comprising a coin sensing station, a coin rundown path extending through the sensing station, the path including a curved coin guiding surface on which a major face of the coin lies in sliding engagement during its passage along the path through the sensing station, and means to relieve a pressure differential between the major face of the coin and the coin guiding surface to inhibit coins sticking to the coin guiding surface. The acceptor may include pressure relief holes through the coin guiding surface.

BRIEF DESCRIPTION OF THE DRAWINGS

In order that the invention may be more fully understood an embodiment thereof will now be described by way of example with reference to the accompanying drawings in which.

DETAILED DESCRIPTION

Overview of Coin Acceptor

Figure 1:
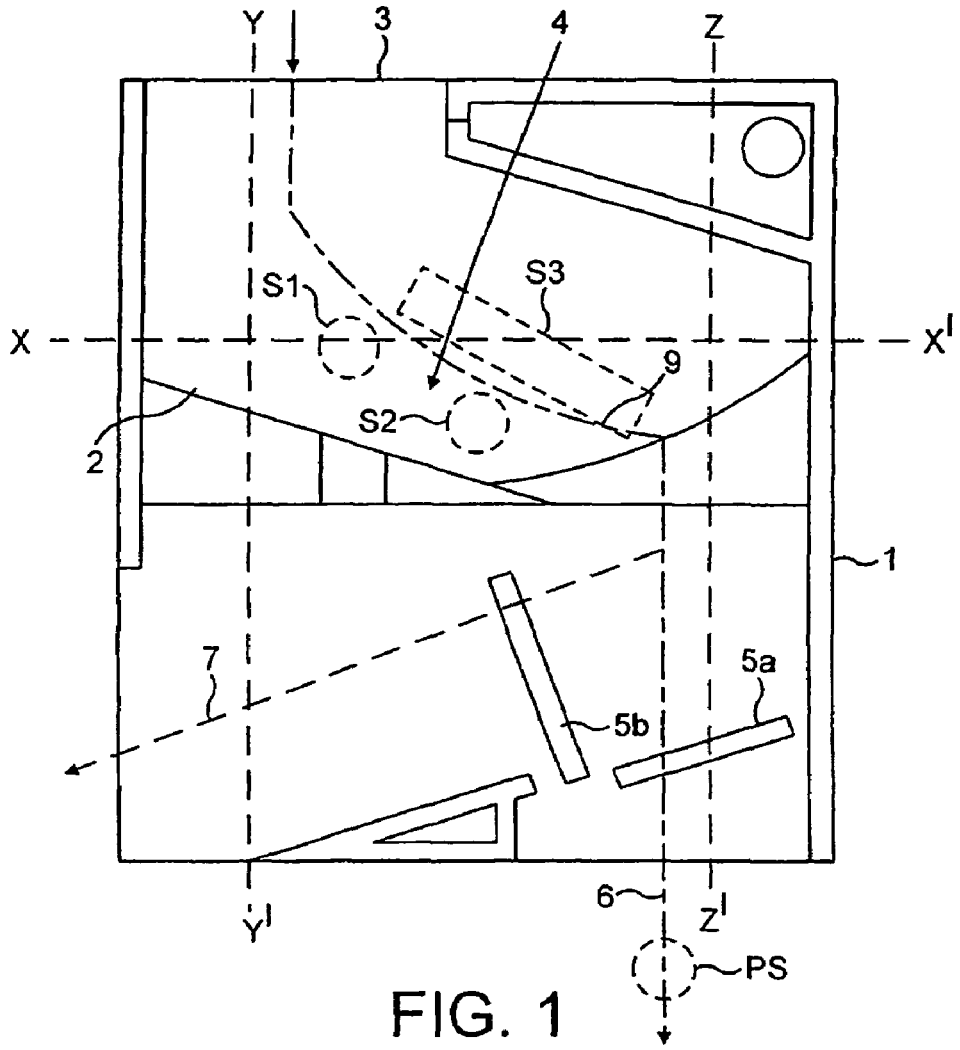
FIG. 1 is a schematic block diagram of a coin acceptor in accordance with the invention.

FIG. 1 illustrates the general configuration of a multi-denomination acceptor according to the invention. The acceptor includes a main body 1 with a coin run-down path 2 along which coins under test pass edgewise from an inlet 3 through a coin sensing station 4 and then fall towards a gate 5 which has first and second gate arms 5*a*, 5*b* that open and close a coin accept path 6 and a coin reject path 7. A test is performed on each coin as it passes through the sensing station 4. If the outcome of the test indicates the presence of a true coin, the gate arm 5*a* is opened and arm 5*b* is closed so that the coin can pass to the accept path 6, but otherwise, the gate arm 5*a* remains closed and the gate arm 5*b* closed so that the coin is deflected to the reject path 7. The coin path through the acceptor for a coin 8 is shown schematically by dotted line 9.

The coin sensing station 4 includes three coin sensing coil units S1, S2 and S3, which are energised in order to produce an inductive coupling with the coin. Also, a coil unit PS is provided in the accept path 6, downstream of the gate 5, to act as a credit sensor in order to detect whether a coin that was determined to be acceptable, has in fact passed into the accept path 6. The credit sensor may be mounted in a cash box (not shown) that receives true coins from the accept path rather than the acceptor itself.

Figure 2:
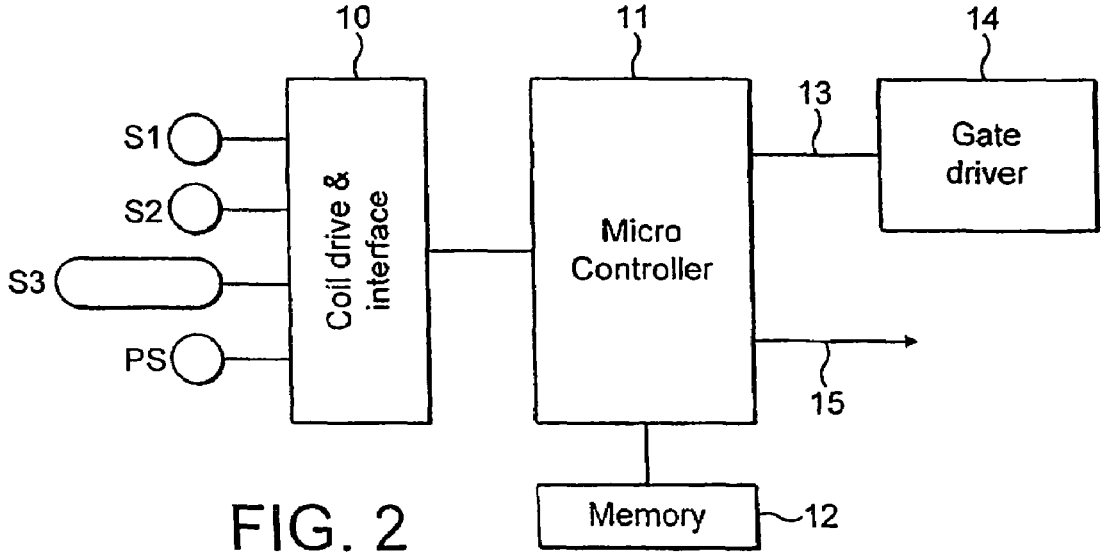
FIG. 2 is a schematic block diagram of the circuits of the acceptor shown in FIG. 1.

The coils are energised at different frequencies by a drive and interface circuit 10 shown schematically in FIG. 2. Eddy currents are induced in the coin under test by the coil units. The different inductive couplings between the four coils and the coin characterise the coin substantially uniquely. The drive and interface circuit 10 produces corresponding digital coin parameter data signals $x_1$, $x_2$, $x_3$ as a function of the different inductive couplings between the coin and the coil units S1, S2, S3 and S4. A corresponding signal is produced for the coil unit PS. The coils S1 and S2 have a small diameter in relation to the diameter of coins under test in order to detect the inductive characteristics of individual chordal regions of the coin. Improved discrimination can be achieved by making the area A of the coil unit S which faces the coin, for the coil units S1 and S2, smaller than 72 $mm^2$, which permits the inductive characteristics of individual regions of the coin's face to be sensed. Coil unit S3 is wound on an elongate bobbin and extends along the coin path. The configuration of the coil units will be explained in more detail hereinafter.

In order to determine coin authenticity, the coin parameter signals produced by a coin under test are fed to a microcontroller 11 which is coupled to a memory 12. The microcontroller 11 processes the coin parameter signals $x_1$,-$x_3$ derived from the coin under test and compares the outcome with corresponding stored values held in the memory 12. The stored values are held in terms of windows having upper and lower value limits. Thus, if the processed data falls within the corresponding windows associated with a true coin of a particular denomination, the coin is indicated to be acceptable, but otherwise is rejected. If acceptable, a signal is provided on line 13 to a drive circuit 14 which operates the gate 5 shown in FIG. 1 so as to allow the coin to pass to the accept path 6. Otherwise, the gate 5 is not opened and the coin passes to reject path 7.

The microcontroller 11 compares the processed data with a number of different sets of operating window data appropriate for coins of different denominations so that the coin acceptor can accept or reject more than one coin of a particular currency set. If the coin is accepted, its passage along the accept path 6 is detected by the post acceptance credit sensor coil unit PS, and the unit 10 passes corresponding data to the microcontroller 11, which in turn provides an output on line 15 that indicates the amount of monetary credit attributed to the accepted coin.

The sensor coil units S each include an inductor coil connected in an individual oscillatory circuit and the coil drive and interface circuit 10 includes a multiplexer to scan outputs from the coil units sequentially, so as to provide data to the microcontroller 11. Each circuit typically oscillates at a frequency in a range of 50-150 kHz and the circuit components are selected so that each sensor coil S1-S4 has a different natural resonant frequency in order to avoid cross-coupling between them.

As the coin passes each of the sensor coil unit S1-S3, its impedance is altered by the presence of the coin over a period of ~100 milliseconds. As a result, the amplitude of the oscillations through the coil is modified over the period that the coin passes and also the oscillation frequency is altered. The variation in amplitude and frequency resulting from the modulation produced by the coin is used to produce the coin parameter signals $x_1$,-$x_3$ representative of characteristics of the coin.

The Coin Rundown Path

Figure 3:
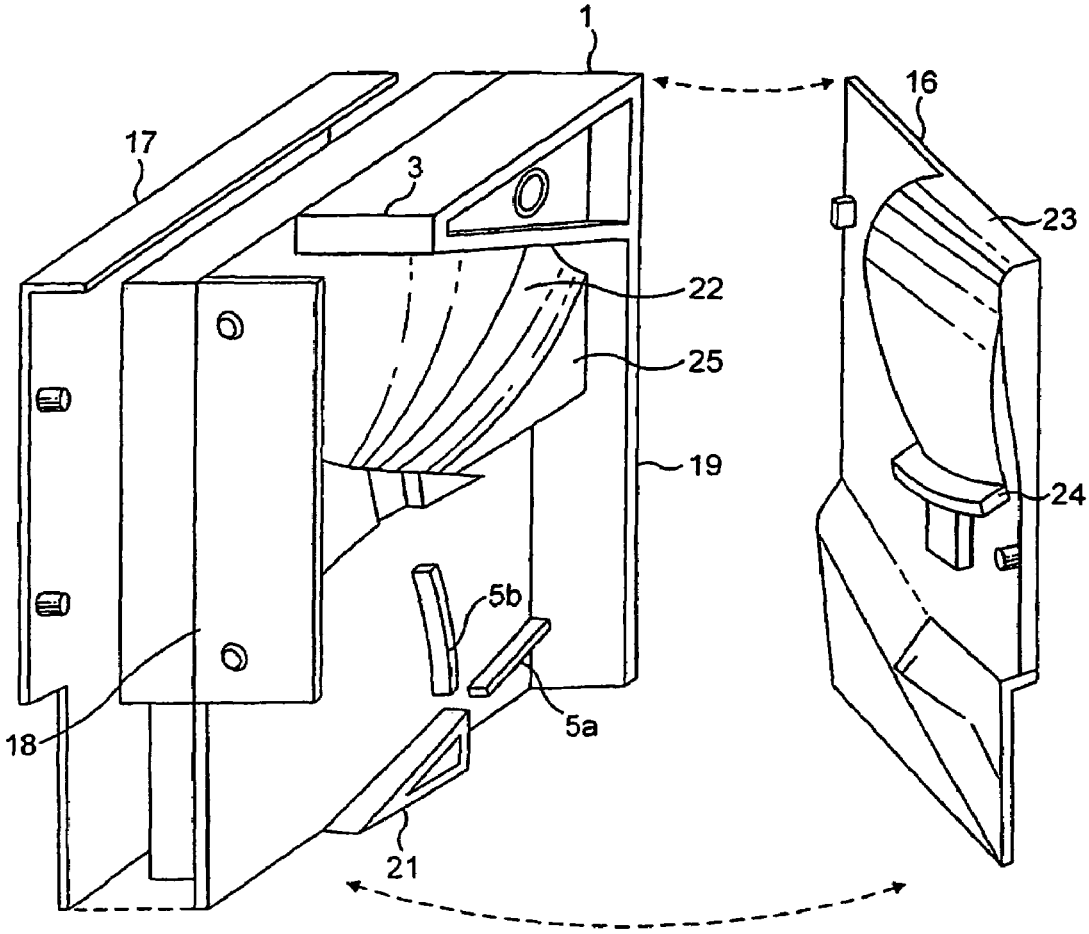
FIG. 3 is schematic, perspective, exploded view of the acceptor.

FIG. 3 is a schematic, perspective, exploded view of the coin acceptor, showing the main body 1 together with left and right covers 16, 17. The path 9 for coins is defined between the main body 1 and the right cover 16. The electronics shown in FIG. 2 are mounted (out of view in FIG. 3) on the main body and is covered by the left cover 17. Both of the covers 16, 17 are fixedly located on the main body 1 in use. There is no conventional door arrangement to allow the release of coin jams. The acceptor has a front side surface 18, rear side surface 19, top surface 20, and underside 21.

Figure 5:
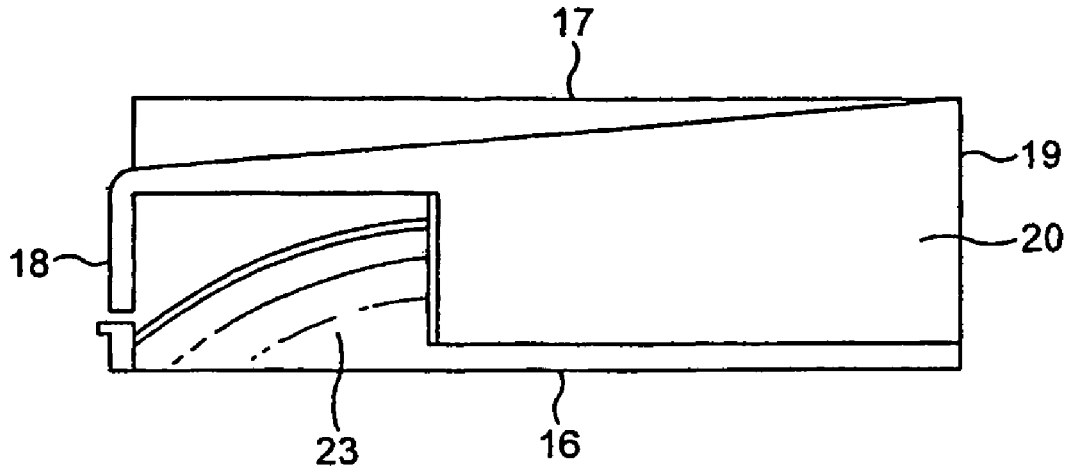
FIG. 5 is a top plan view of the acceptor.

The coin rundown path 2 is defined by a curved surface 22 on the main body 1 and a curved coin guiding surface 23 on the right side cover 16. The coin guiding surface 23 extends into the coin inlet 3 as can be seen from the top plan view of FIG. 5. The curvature of the coin guiding surface 23 decreases towards the front side surface 18 so as to guide incoming coins towards the front side wall 18 as they enter the acceptor through the coin inlet 3. This will be explained later.

Figure 4:
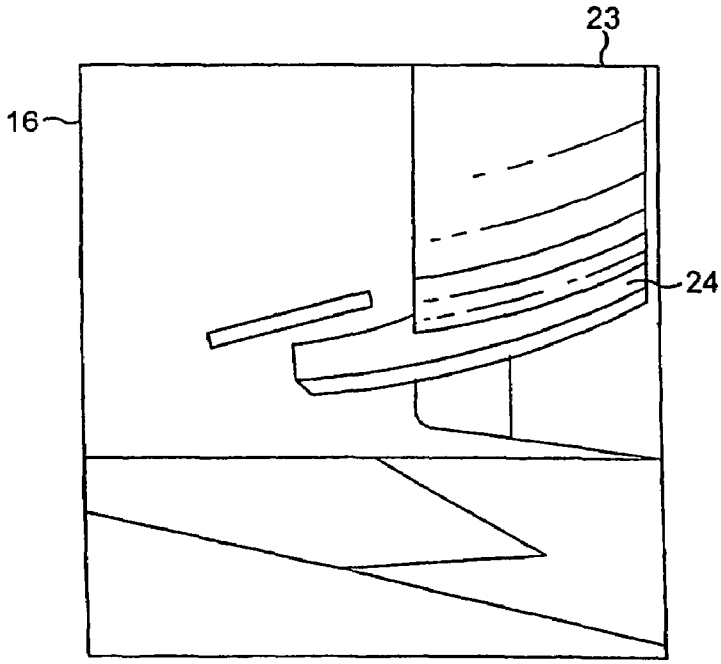
FIG. 4 is a side view of the interior surface of the right side cover.

Referring to FIGS. 3 and 4, the right side cover also includes an inclined, coin rundown edge 24 to guide coins along the rundown path 2.

Figure 6:
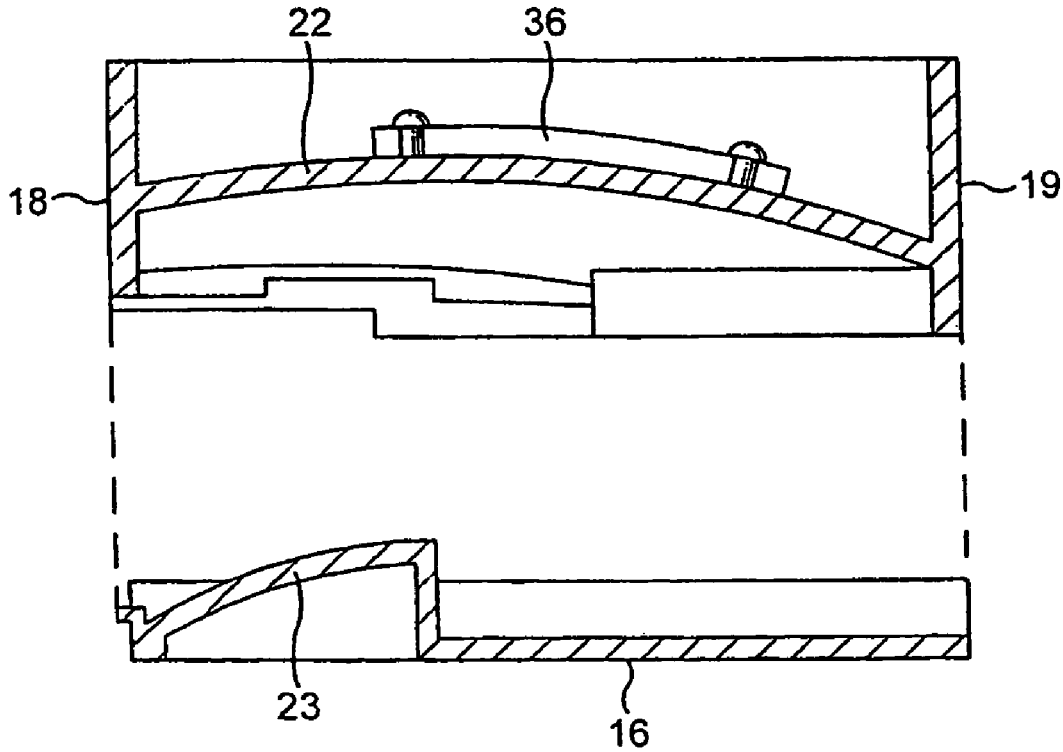
FIG. 6 is a horizontal sectional view of the acceptor taken along the line X-X' in FIG. 1, with the right side cover shown detached from the body and the left side cover omitted.
Figure 7:
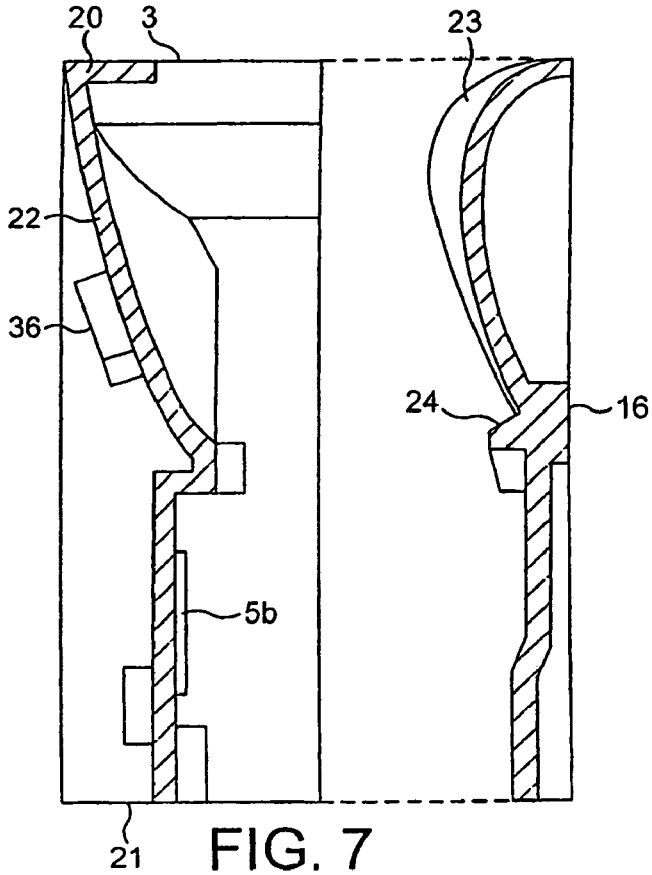
FIG. 7 is a vertical sectional view of the acceptor taken along the line Y-Y' in FIG. 1, with the right side cover shown detached from the body and the left side cover omitted.
Figure 8:
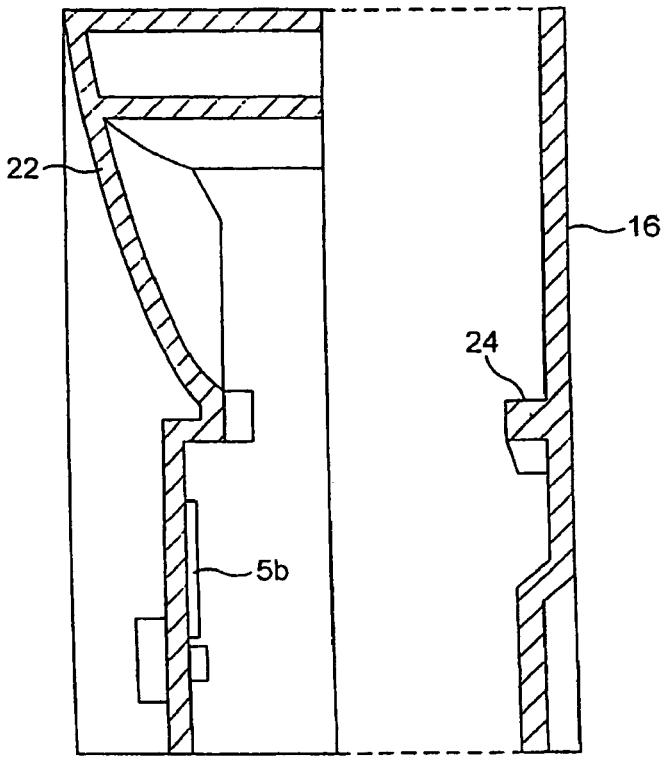
FIG. 8 is a vertical sectional view of the acceptor taken along the line Z-Z' in FIG. 1, with the right side cover shown detached from the body and the left side cover omitted.

As shown in the sectional view of FIGS. 6-8, the coin guiding surface 22 is curved both when viewed in horizontal and vertical section and extends from the coin inlet 3 to a generally vertical planar surface region 25 on the main body 1, illustrated in FIG. 3.

Figure 9:
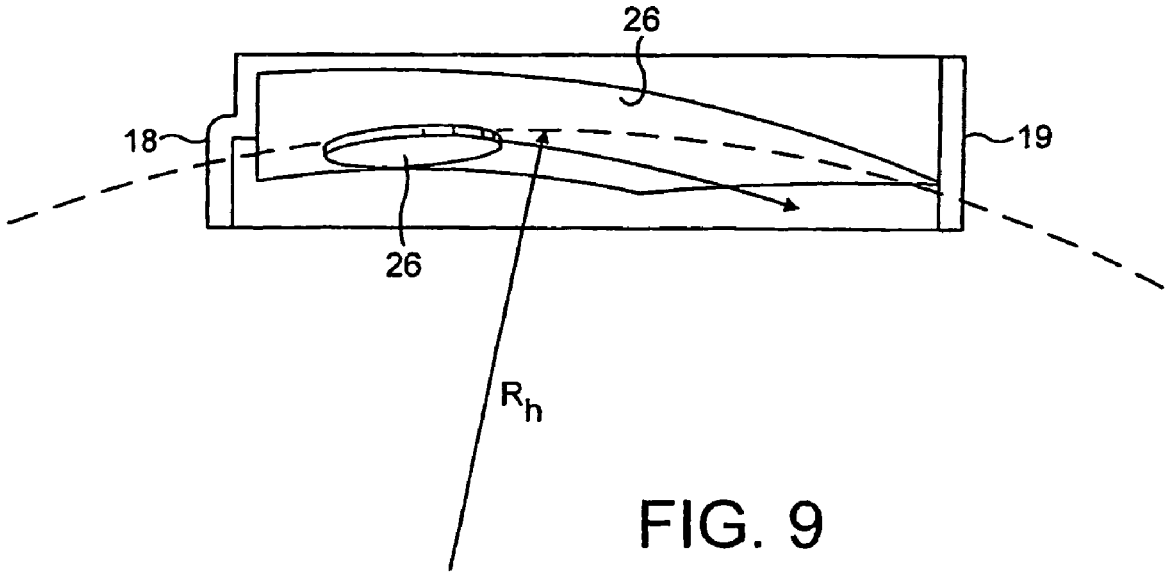
FIG. 9 illustrates the horizontal curvature of the coin guiding surface through the coin sensing station.
Figure 10:
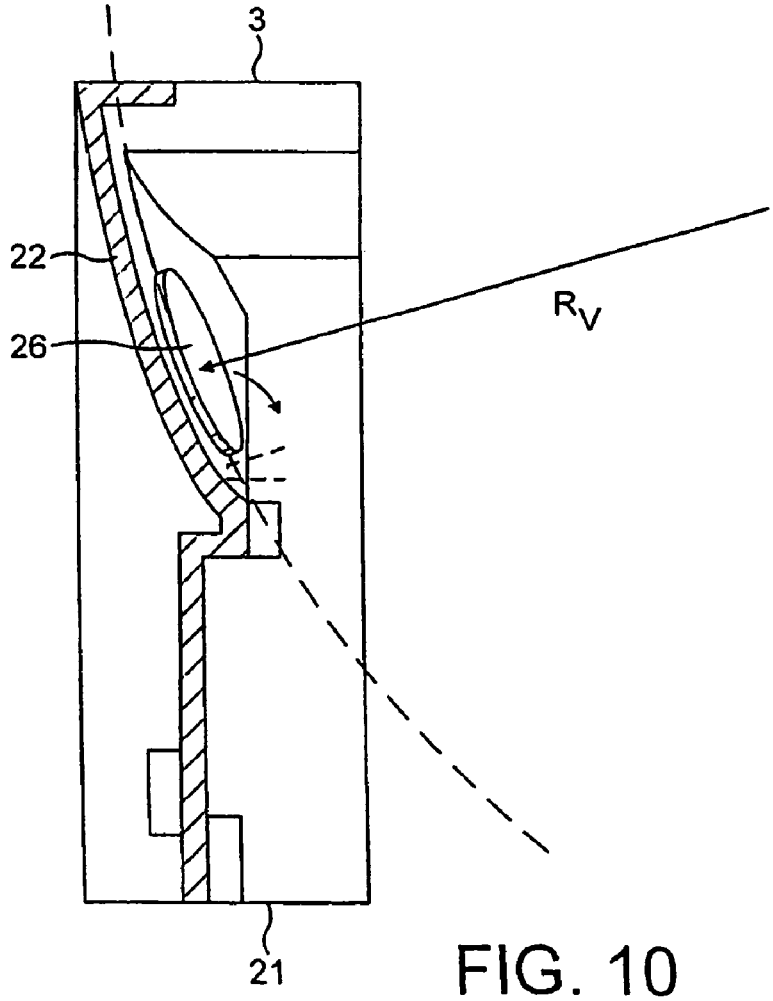
FIG. 10 illustrates the vertical curvature of the coin guiding surface through the coin sensing station.

As shown in FIGS. 9 and 10, the surface 22 has a radius of curvature $R_h$ in a horizontal direction and also a curvature $R_v$ in horizontal section. Thus, as the coin moves across the surface 22 as it travels along the path 9, it moves both in a horizontal and vertical curve.

Figure 11:
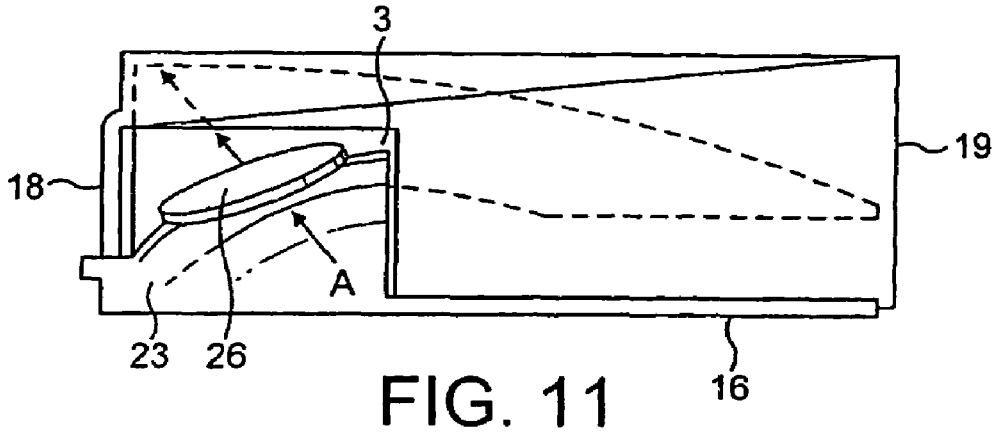
FIG. 11 is a top plan view of the acceptor when a coin enters its coin inlet.
Figure 12:
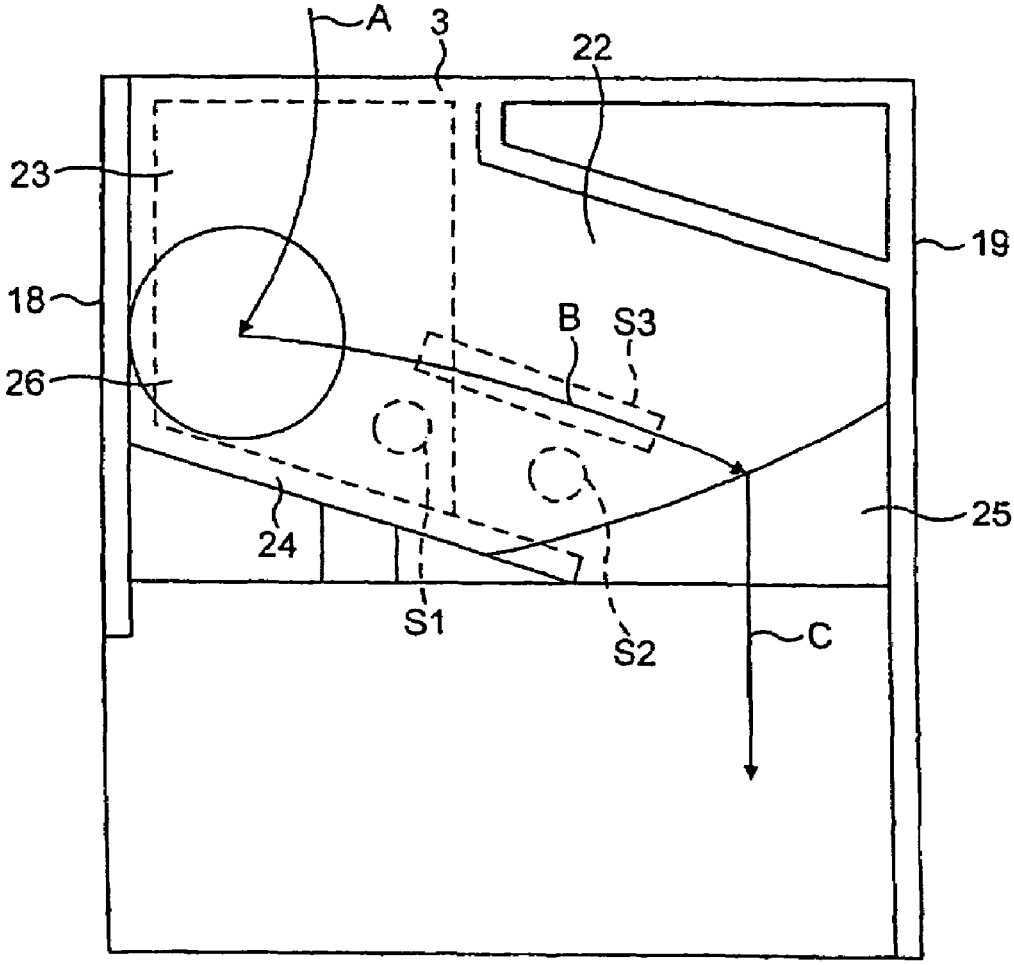
FIG. 12 is a schematic illustration of the passage of the coin through the coin sensing station.

FIGS. 11 and 12 illustrate the passage of a coin 26 through the coin sensing station 24. As shown in FIG. 11, when coin 26 is inserted into the coin inlet 3, the curved surface 23 on the right side cover 16, guides the coin onto the curved surface 22 on the main body 1 and also directs it towards the front side wall 18 into the position shown in FIG. 12. The coin thus travels in the direction of arrow A from the inlet 3 to the position shown in FIG. 12.

Thereafter, the coin 26 moves in a curved path shown by arrow B through the coin sensing station. The coin falls by gravity down the inclined ledge 24 and the generally vertically and horizontally curved nature of the surface 22 ensures that one of the major circular side faces of the coin 26 is slidably engaged with surface 22 and is urged by a centripetal force against the surface 22 as it moves along path B through the sensing station 4. Thus, tendency for the coin to wobble is materially reduced due to the fact that it is held by centripetal force in sliding engagement with the surface 22. In contrast, conventional validators have used a linear path so that even if the coin were inclined to the vertical, the rotating coin would tend to try and stand upright as a result of its rotation thereby inducing coin wobble.

When the coin reaches the end of path B, it then falls due to gravity along path C over the generally vertical surface 25 to be accepted or rejected on accept path 6 or reject path 7 in the manner previously described, under the control of gate 5.

Since the coin 26 is urged against surface 22 by centripetal force, spacing between the side walls of the coin rundown path can be made larger than in conventional coin acceptors, obviating the requirement for a hinged door to release coin jams. Thus, the right side cover 16 can be fixedly attached to the main body 1 without the need for a hinged coin door to clear coin jams.

Figure 13:
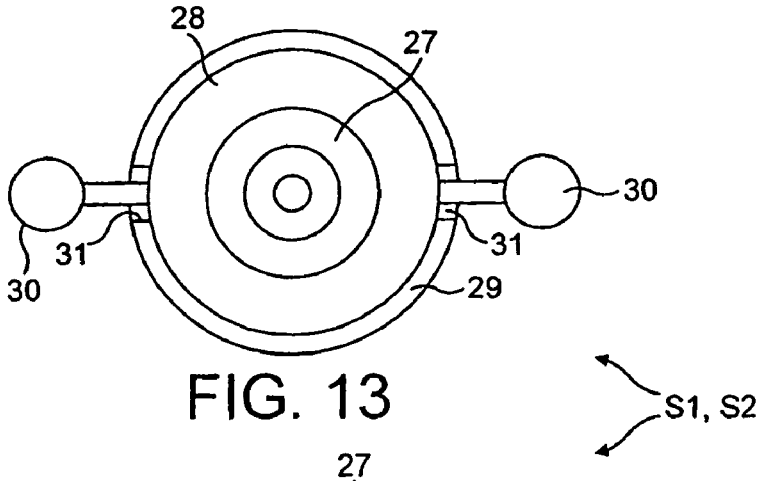
FIG. 13 is a plan view of one of the sensor coils S1, S2.
Figure 14:
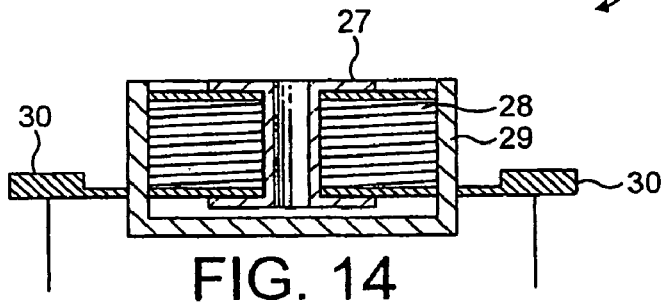
FIG. 14 is a sectional view of the coil shown in FIG. 13.

The configuration of the sensor coils S1, S2 and S3 will now be described in more detail. FIGS. 13 and 14 illustrate the construction of the sensor coils S1 and S2. Each of the coils comprises a generally cylindrical bobbin 27 of plastics material, on which windings of a coil 28 are formed. Bobbin 27 is push fitted into a so-called half pot core 29 made of sintered ferrite material. The ends of the winding 28 are mounted in plastics terminal pieces 30 that extend through slots 31 in the cylindrical side wall of the half pot core 29.

Figure 15:
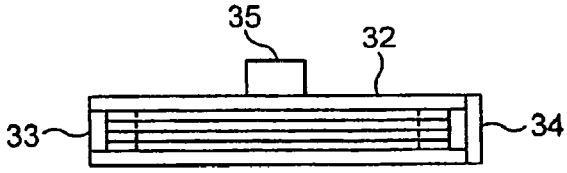
FIG. 15 is a top plan view of the sensor coil S3.
Figure 16:
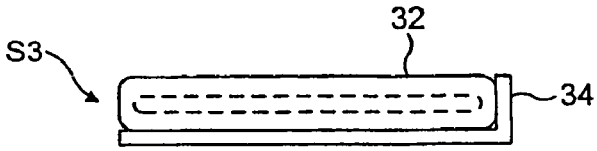
FIG. 16 is a side view of the coil shown in FIG. 15.
Figure 17:
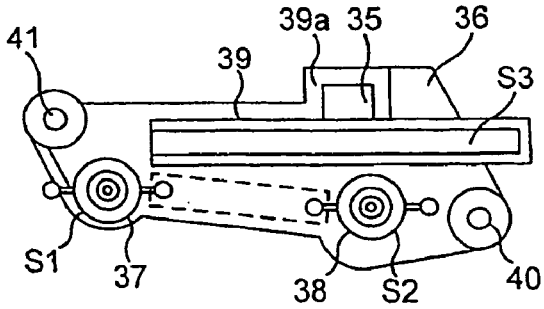
FIG. 17 is a plan view of a mounting for the sensor coils.

FIGS. 15 and 16 are plan and side views respectively of the sensor coil S3. The coil comprises an elongate bobbin 32 made of ferrite material on which copper windings 33 are formed. The bobbin is mounted on a rectangular mounting bracket 34 that has a locating lug 35. The coils S1, S2 and S3 are push fitted into a mounting bracket 36 is provided with recesses 37, 38 and 39 to receive the coils S1, S2 and S3 respectively, with the recess 39 including a region 39*a* to receive the locating lug 35 on coil S3. The mounting bracket 36 is held by screws fitted through mounting holes 40, 41 on the rear of the inclined surface 22 as illustrated in FIG. 6.

Figure 18:
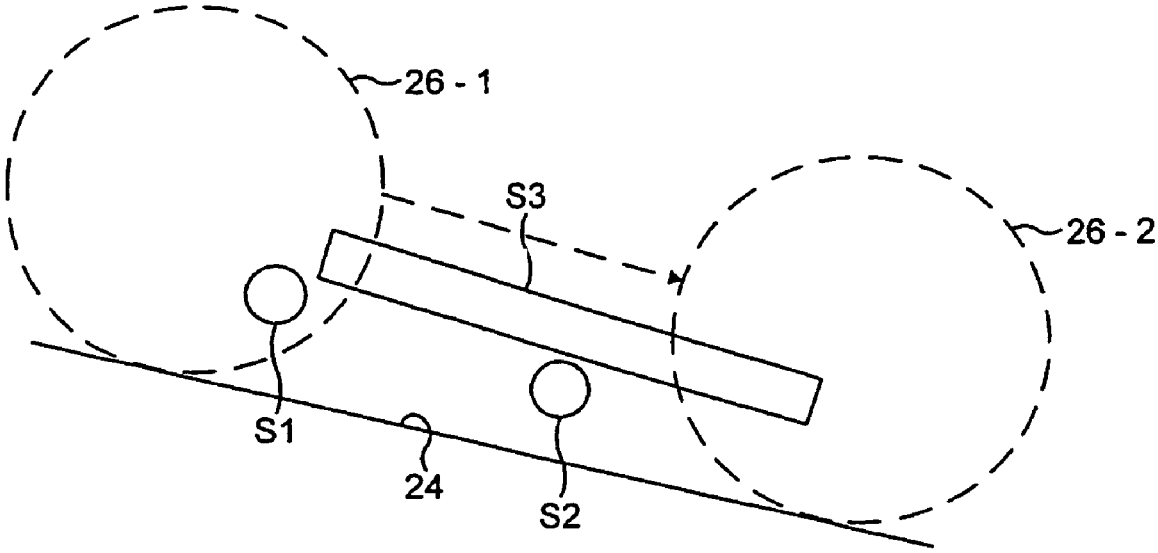
FIG. 18 is a schematic illustration of the interaction between the coin and the sensor coils.
Figure 19:
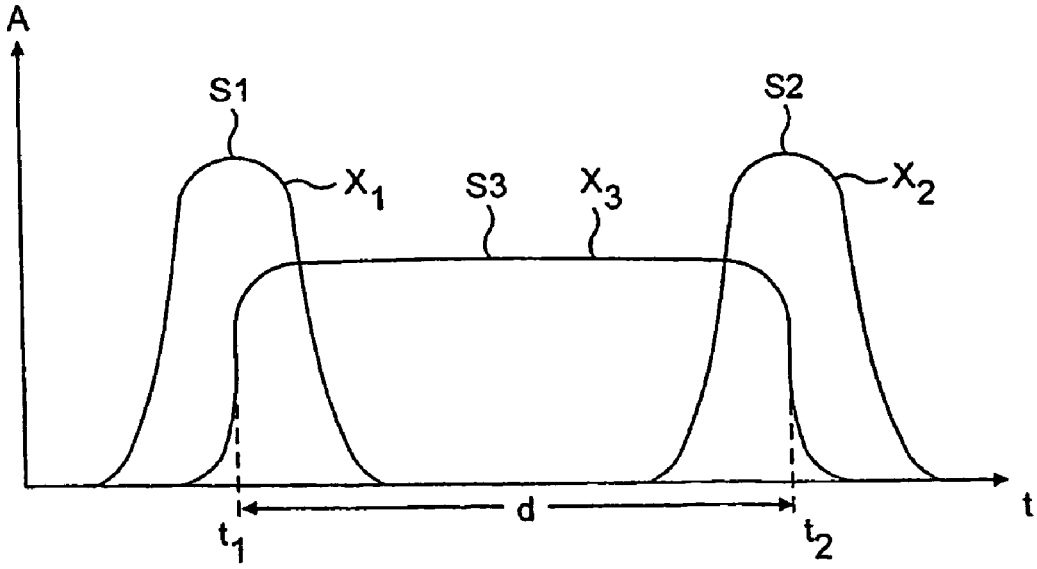
FIG. 19 is an illustration of the waveforms produced by the interaction of FIG. 18.

FIGS. 18 and 19 illustrate the response produced by the sensor coils S1, S2 and S3 as coin 26 on the curved surface 22. In FIG. 18, the coin 26 is shown moving from position 26-1 to 26-2. As the coin 26 moves past coil S2, it forms a inductive coupling with the coil and a corresponding coin parameter signal $x_1$ produced by the coil S1 is shown in FIG. 19 as a function of time. The amplitude deviation of the signal $x_1$ is a function primarily of the material of which the coin is made and the coil senses the material content of the coin along the chordal region of the coin. A similar output is produced by coil S2. Since coil S2 is energised in a different frequency from coil S1, the amplitude deviation is different but similarly dependent on the material from which the coin is made.

The elongate coil S3 provides an indication of the diameter of the coin. As the coin passes the coil, a generally rectangular amplitude deviation $x_3$ is produced as shown in FIG. 19 and it will be understood that the width d of the pulse, from time t1 to t2, is dependent on coin diameter. It has been found in accordance with the invention that the elongate coil S3 provides a highly reliable indication of coin diameter.

An advantage of the arrangement of coils S1-S3 is that they are all mounted on the same side of the coin rundown path, on the rear wall of the main body that provides the curved surface 22. Thus, the inductive coupling with a coin under test can reliably be formed with the coils through the curved surface 22, and the coin is urged against it by centripetal force, as previously explained. Therefore the distance between the coin under test and the coils S1-S3 remains substantially constant from coin to coin, which improves reliability of the coin parameter signals produced by the coils.

Also, providing the coils S1-S3 only one side of the path 2 has the advantage that no electrical connections need to be made between the main body 1 and the right cover 16, which reduces the cost of the coin acceptor.

Figure 20:
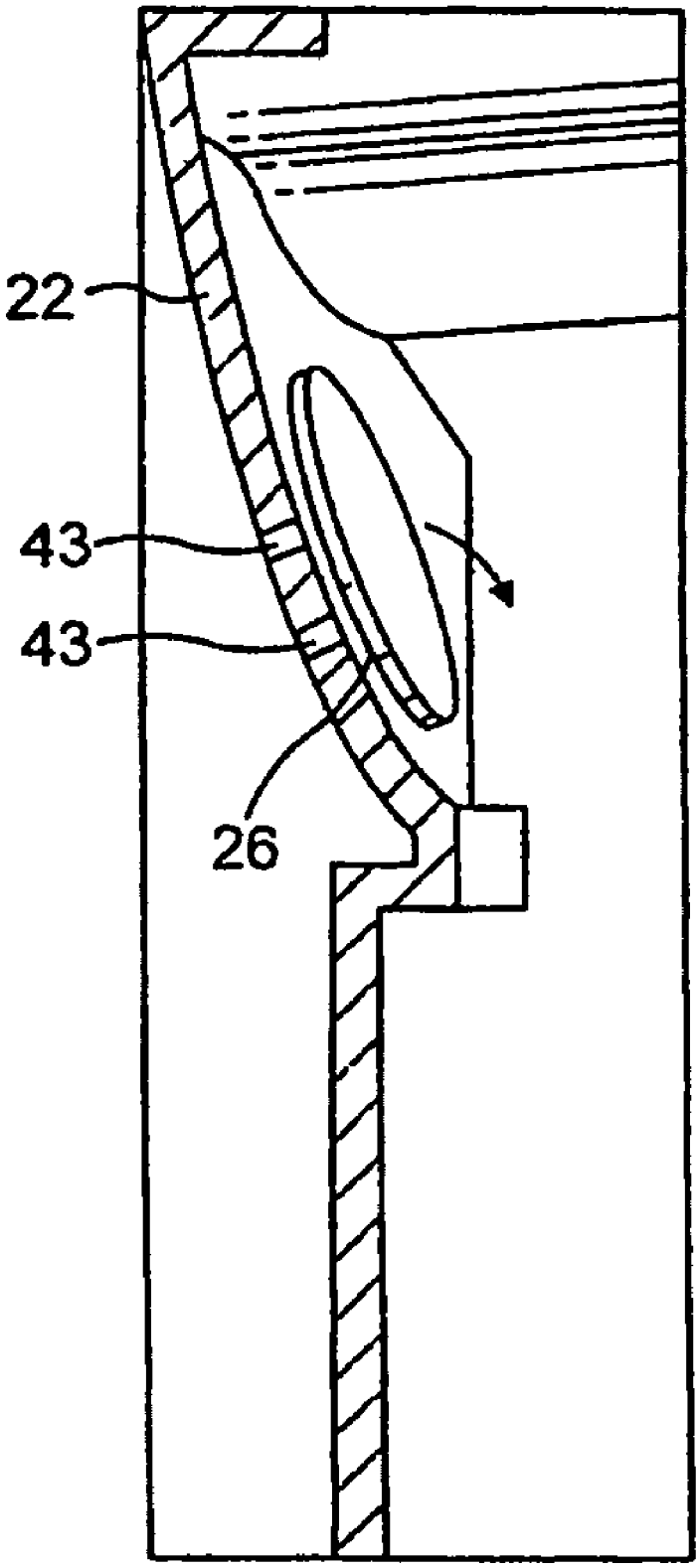
FIG. 20 is a schematic sectional view corresponding to FIG. 10, of a modified coin guiding surface

Referring now to FIG. 20, a modification of the acceptor is shown, in which the curved surface 22 includes negative pressure relief holes 43. It has been found that as the coin 26 slides over the surface 22, the intimate contact between the coins and the surface can give rise to a negative pressure region being developed between the surface of a coin that contacts the curved surface 22, to which can impede progress of the coin along the path. In accordance with the invention, the negative pressure relief holes 43 cause any negative pressure to be released and thereby free up the progress of the coin along the rundown path.

Many modifications and variations fall within the scope of the invention. For example, whilst the acceptor has been described for use with coins, it can also be used with tokens and other similar items with an attributable monetary value. Also, the retaining force for the coin as it moves over the curved surface may comprise a centrifugal force and the term centripetal as used herein is to be interpreted accordingly.

The invention claimed is:

1. A coin acceptor comprising:

a coin sensing station, a coin rundown path extending through the sensing station, the coin rundown path including a coin guiding surface on which a major face of the coin lies in sliding engagement during its passage along the path through the coin sensing station, wherein the path is curved such that the face of the coin is urged by centripetal force against the coin guiding surface as it moves along the path and through the coin sensing station.

2. A coin acceptor according to claim further comprising:

a body including the coin guiding surface, and a cover mounted on the body, wherein the coin rundown path extends between said surface and the cover.

3. A coin acceptor according to claim 2 wherein the cover is fixedly mounted on the body, without a coin jam release mechanism.

4. A coin acceptor according to claim 1 further comprising:

a coin inlet opening and a curved inlet surface for guiding a coin inserted in the coin inlet to a particular region of the coin guiding surface.

5. A coin acceptor according claim 1 wherein the coin guiding surface is configured to relieve a pressure differential between the major face of the coin and the coin guiding surface.

6. A coin acceptor according to claim 1 wherein the coin rundown path extends through sensor coils at the coin sensing station, and one of said sensor coils comprises an elongate winding extending longitudinally along the coin rundown path.

7. A coin acceptor according to claim 6 wherein said one of the coils is wound on an elongate former which is longer than it is wide.

8. A coin acceptor according to claim 7 wherein said one of the coils is longer than the maximum diameter of coins to be accepted thereby.

9. A coin acceptor according to claim 6 including at least one coil of circular cross section at the sensing station.

10. A coin acceptor according to claim 9 wherein the circular coil has a diameter smaller than the minimum diameter of coins to be accepted thereby.

11. A coin acceptor according to claim 6 further comprising:

processing circuitry coupled to the elongate coil to derive therefrom a coin parameter signal as a function of coin diameter.

12. A coin acceptor comprising:

a coin sensing station, a coin rundown path extending through the coin sensing station, the coin rundown path including a curved coin guiding surface on which a major face of the coin is urged by centripetal force to lie in sliding engagement during its passage along the coin rundown path through the coin sensing station, and a side wall opposite to the curved coin guiding surface, said coin rundown path extending between the coin guiding surface and the sidewall, wherein said side wall is fixedly mounted relative to the curved coin guiding surface.

13. A coin acceptor comprising:

a coin sensing station, a coin rundown path extending through the coin sensing station, the coin rundown path including a curved coin guiding surface on which a major face of the coin lies in sliding engagement during its passage along the coin rundown path through the coin sensing station, and means to relieve a pressure differential between the major face of the coin and the curved coin guiding surface to inhibit coins sticking to the curved coin guiding surface.

14. A coin acceptor according to claim 13 including pressure relief holes through the coin guiding surface.

* * * * *